US005806250A

United States Patent [19]

Medeot et al.

[11] Patent Number: 5,806,250

[45] Date of Patent: Sep. 15, 1998

[54] MULTIDIRECTIONAL MECHANIC HYSTERESIS ANTI-SEISMIC DEVICE FOR INSULATING THE BASES OF CONSTRUCTIONAL SYSTEMS HAVING HIGH MATUAL DISPLACEMENTS

[75] Inventors: Renzo Medeot; Renato Chiarotto, both of Selvazzano Dentro, Italy

[73] Assignee: Fip Industriale S.p.A., Selvazzano Dentro, Italy

[21] Appl. No.: 720,143

[22] Filed: Sep. 25, 1996

[30] Foreign Application Priority Data

Jul. 12, 1996 [IT] Italy ..... MI96A1447

[51] Int. Cl.[6] ..... E02D 27/34; E04B 1/98; E04H 9/02

[52] U.S. Cl. ..... 52/167.1; 52/167.4; 52/167.8

[58] Field of Search ..... 52/167.4, 167.7, 52/167.8, 167.1

*Primary Examiner*—Christopher Kent
*Attorney, Agent, or Firm*—Bucknam and Archer

[57] ABSTRACT

A multidirectional antiseismic device dissipates mechanical energy and limits loads; it can be used to connect structural sub-systems or insulate at the base entire structures, especially in cases involving significant relative displacements between connected structural sub-systems. The multidirectional dissipating device is essentially constituted by pluralities of metallic elements, especially shaped and arranged in specific configurations. Two of these are "radial" configurations whereas a third type is "annular". In each case, the configurations extend between an abutment and anchoring top construction and an abutment and anchoring bottom construction.

12 Claims, 8 Drawing Sheets

MULTIDIRECTIONAL MECHANIC HYSTERESIS ANTI-SEISMIC DEVICE FOR INSULATING THE BASES OF CONSTRUCTIONAL SYSTEMS HAVING HIGH MATUAL DISPLACEMENTS

FIELD OF THE INVENTION

The present invention relates to an anti-seismic device, designed as a mechanical energy dissipating and load limiting device, of a multidirectional type, which can be used for connecting structural subsystems or for insulating the base portions of structural systems and which is particularly suitable for in cases of significant relative displacements of the connected portions.

BACKGROUND OF THE PRIOR ART

A previous patent application in the name of the same applicant, Italian patent application No. 22114 A/89, filed on Oct. 24, 1989 incorporated herein by reference, illustrates anti-seismic devices using a specifically designed curved element, shown in FIG. 1, having a variable section crescent-moon shaped element having two enlarged portions at the ends through which holes are formed to provide pivoting hinge connections.

When external forces are applied to the enlarged end portions, the crescent moon shaped element undergoes deformation assuming a well defined configuration and the related force-deformation curve is of the conventional elasto-plastic type.

By radially arranging any desired number of the mentioned crescent-moon elements greater than three, for example 3,4,5 . . n of said elements the anti-seismic device shown in the above mentioned patent application No. 22114 A/89 is obtained which can be either of the isotropic multi-directional type or not, depending on the particular arrangement of the dissipating elements which may be equally spaced or clustered in a given direction.

As it is known, the reason for adopting these devices is that seismic forces will produce abrupt displacements of the soil with which are associated great accelerations which, as transmitted through the foundations, will generate inertial forces, because of the comparatively large masses constituting the structural construction of bridges, buildings and the like.

Also known is the fact that, during a seismic event, large amounts of energy are generated, which is propagated through the soil so as to penetrate into the structures.

This energy represents, in actual practice, the main cause of possible damages due to the seismic event.

Furthermore, it is also known that by using suitable uncoupling devices, such as, for example, those disclosed in the above mentioned patent application, suitably arranged, it is possible to reduce the amount of energy which penetrates into the structures, as well as the load and displacements produced.

For example, in the case of bridges and viaducts, elastic devices have been used, which are specifically designed for providing an oscillating system, constituted by the mentioned devices, that is the springs and by the construction to be protected (the mass), which oscillating system has a proper resonance frequency, which can be arranged outside of the area of high energy contents region of the frequency spectrum, which is a characteristic of the seismic events, thus providing a great reduction of the seismic response.

In other words, the seismic energy is reflected by the above mentioned elastic devices, with the exception of that portion which is associated to a frequency equal to or near the resonance frequency.

However, the structure considered as an oscillating system will anyhow tend to accumulate the portion of energy in the mentioned spectrum range so that a dissipating device must be used for dissipating the mentioned energy in the form of heat.

Several physical mechanisms can be used for dissipating this energy and can be classified in several types.

In the present invention the dissipating capacity of soft steel or alloys of like performance where these materials are stressed beyond their yield point, is exploited.

A first phase of proportionality between the forces and deformation is followed by a phase in which there is little dependence of the power on the latter.

Thus, the devices constructed on such a constructional principle can be considered as load limiting devices.

Accordingly, when these devices are introduced into suitable points of the construction, the forces transmitted between the connected elements will be limited to values which can be easily established by a skilled designer.

From a dynamic standpoint, the adoption of horizontal restraining devices having a mainly elasto-plastic behavior, will be the same as introducing in series with a "spring", also an energy "dissipating element" having a comparatively high hysteretic capacity which, by plastic deformations will provide a ductility very favorable for the overall construction.

By means of the mentioned dissipating devices, it will be possible to remarkably reduce the spectral response, during violent seismic events, in terms of the accelerations of the overall constructional system, with a great reduction of the stresses on the supporting structures in particular.

These anti-seismic devices have been frequently used on railroad bridges and road bridges.

A modern trend is that of making these mentioned devices according to increasingly daring solutions so that comparatively larger movements between the supported construction and the supporting elements (columns and shoulders), are obtained.

SUMMARY OF THE INVENTION

Thus, the aim of the present invention is to solve the above mentioned problem, by providing a device which is specifically designed for overcoming all the difficulties related to comparatively small displacements while holding at a minimum the dimensions.

Within the scope of the above mentioned aim, a main object of the present invention is to provide such an anti-seismic device which allows comparatively large movements, without the need of using comparatively larger sized crescent moon elements.

Yet another object of the present invention is to provide such an anti-seismic device which allows to hold very reduced the plan size of the assembly.

Yet another object of the present invention is to provide such an anti-seismic device which can be easily constructed from commercially available elements and materials and which, moreover, is very competitive from a mere economical standpoint.

According to one embodiment the present invention, the above mentioned aim and objects, as well as yet other objects, which will become more apparent hereinafter, are achieved by an anti-seismic device, characterized in that said device comprises at least two curvilinear elements, arranged on overlaying planes, to absorb horizontal displacements without increasing the plan view dimensions of the assembly.

BRIEF DESCRIPTION OF THE DRAWINGS

Further characteristics and advantages of the present invention will become more evident from the following description of some embodiments which are illustrated, by way of example, but not limitative examples, in the accompanying drawings in which.

DESCRIPTION OF THE PREFERRED EMBODIMENTS

Figure 3:
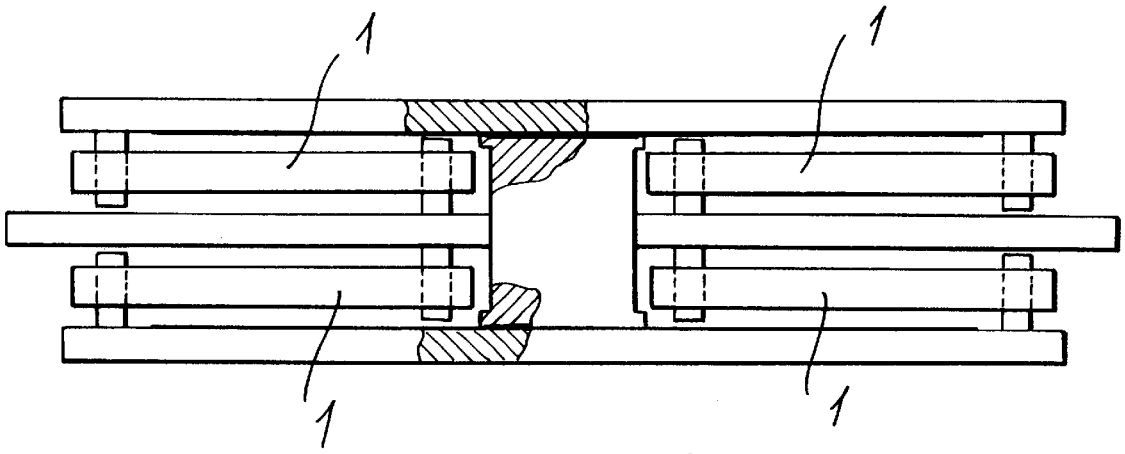
FIG. 3 illustrates an anti-seismic device made by superimposing, on different planes, several crescent moon elements.

With reference to the numeral references in the figures of the above mentioned drawings, an elementary solution for doubling, triplicating, etc., the displacements could be those of superimposing, as shown in FIG. 3, two or more devices as those disclosed in the above mentioned patent application.

The top plan dimensions would be held unchanged, whereas the height would be nearly doubled, which, however, usually is not critical.

A limitation of this solution, which is covered by the present application is self-evident in the case in which it is desired to add to the device a bearing capacity, thereby providing an "insulator" device.

This can be obtained (see FIG. 4) by introducing a bearing apparatus, after having enlarged the central pivot pin (10) and having added two sliding pairs (1) made, by way of a not limitative example, of PTFE, and stainless steel.

Figure 4:
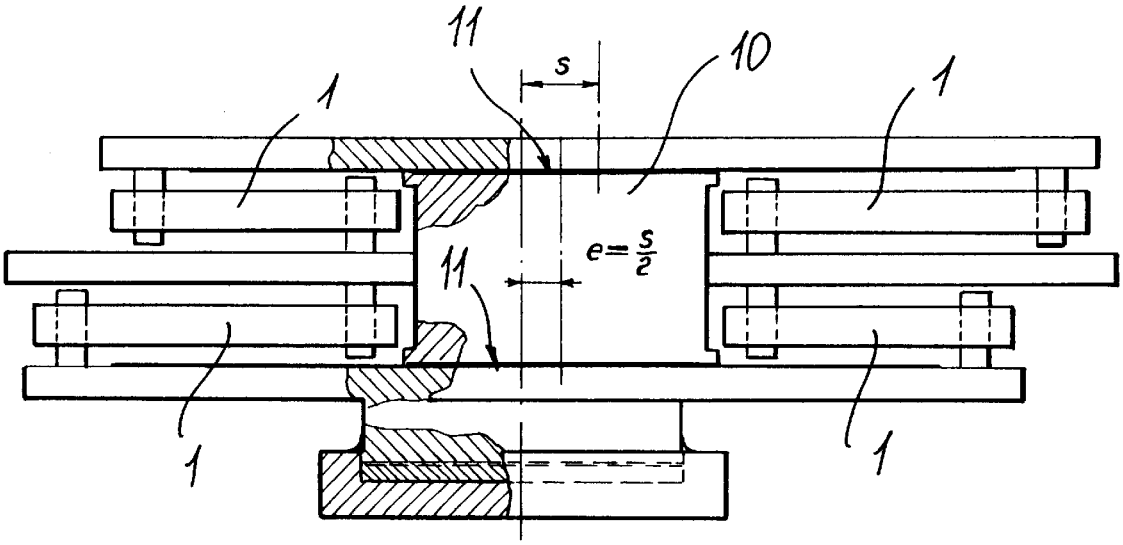
FIG. 4 illustrates the device shown in FIG. 3, with the addition of a bearing.

With reference to FIG. 4 it should be apparent that, in the presence of an overall sliding displacement (2), an undesired eccentricity e=s/2 of the vertical load on the bearing apparatus will be generated.

A preferred device is that which will be hereinbelow described and which can be called a "radial embodiment".

Figure 2:
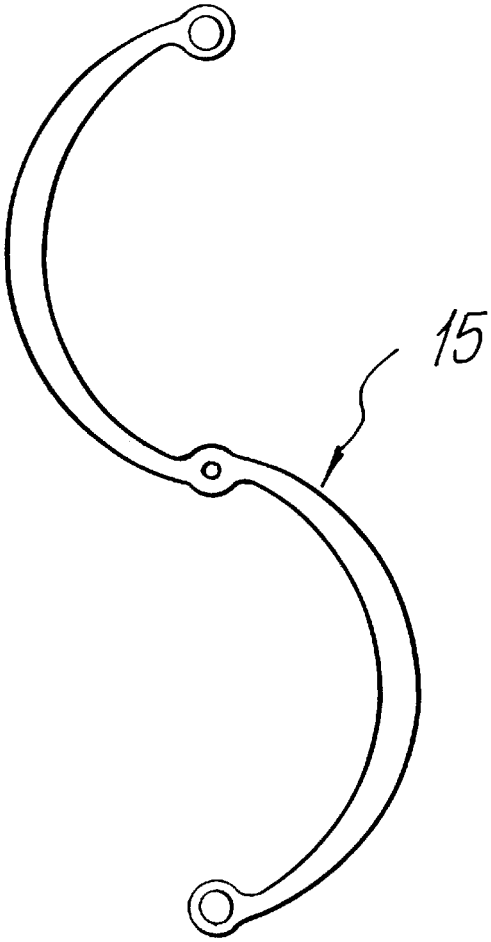
FIG. 2 illustrates an S-shape modular element.

For making such a device, are used the dissipating elements (15), shown in FIG. 2, to which external forces are applied at the points A and B, whereas the point C is left free.

Figure 5:
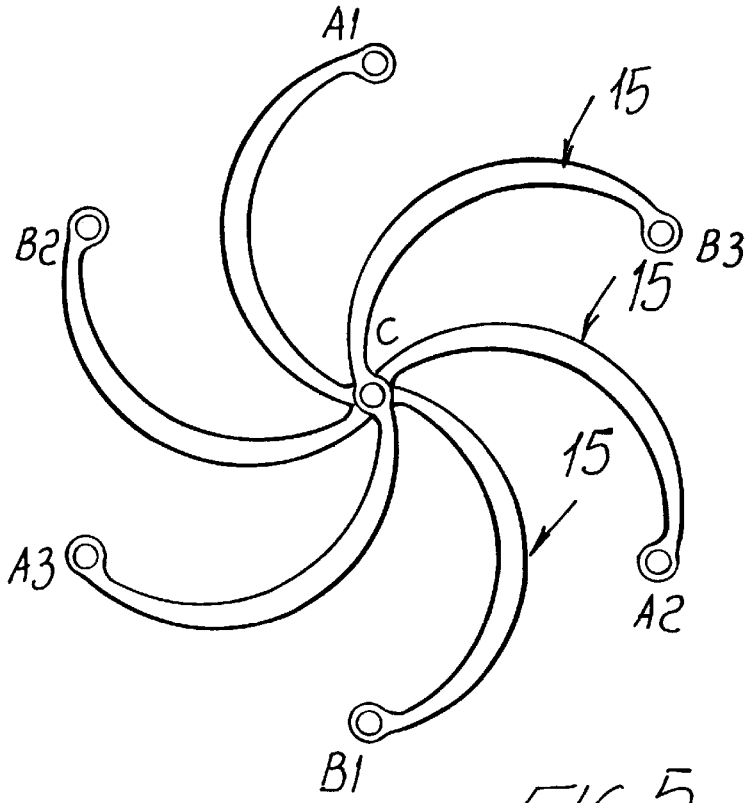
FIG. 5 illustrates a device made by coupling several S-shape elements.

The elements, shown in FIG. 2, can not operate individually, because of the generation of instability effects, and, accordingly, they can be arranged in arrangements similar to those shown in FIG. 5.

The S-shape element shown in FIG. 2 can be exclusively used in an odd number (3, 5, 7 and so on).

Figure 6:
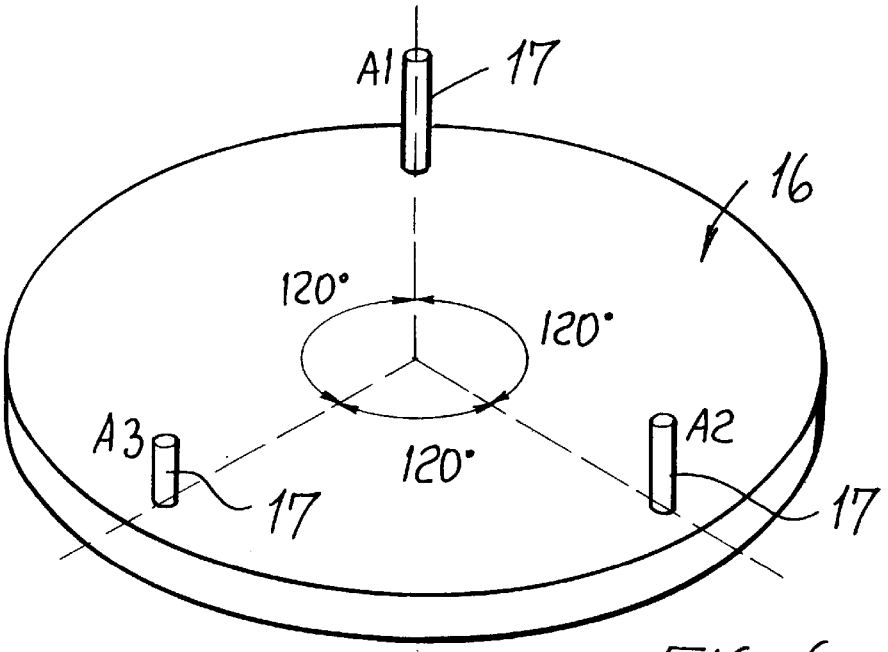
FIG. 6 illustrates one of the two supporting plates of the device shown in FIG. 5.
Figure 7:
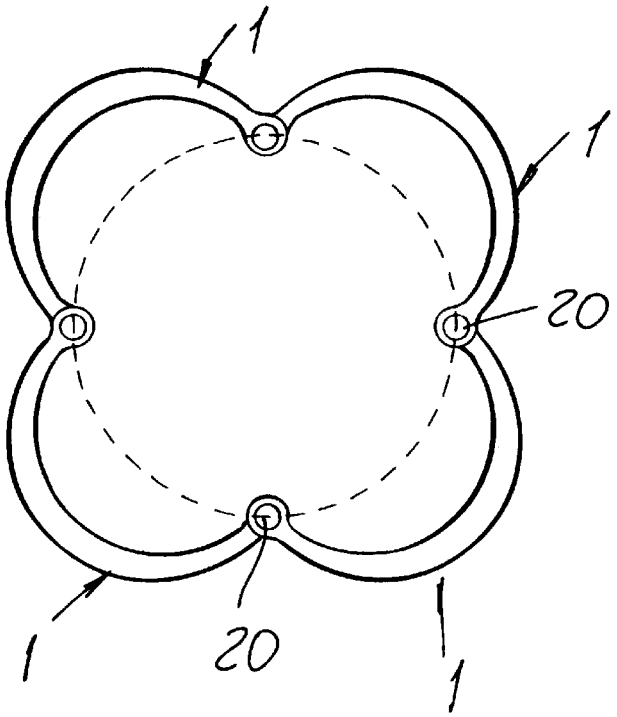
FIGS. 7 to 10 illustrate top plan view of corresponding annular devices.
Figure 8:
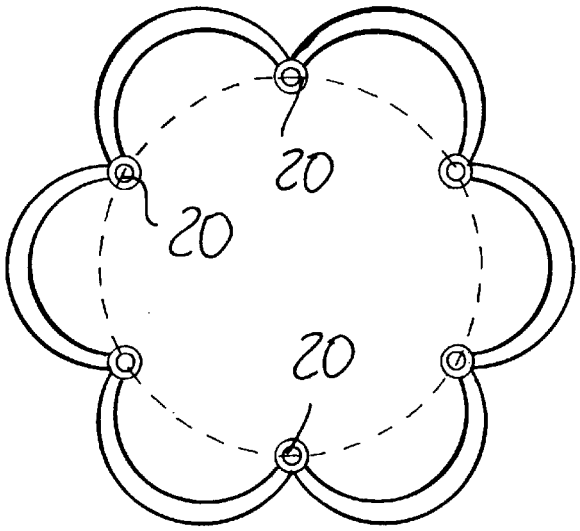
Figure 9:
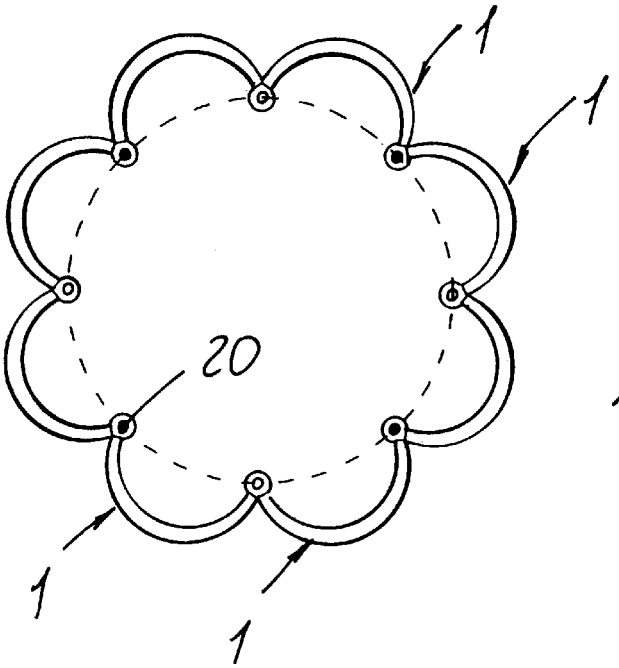
Figure 10:
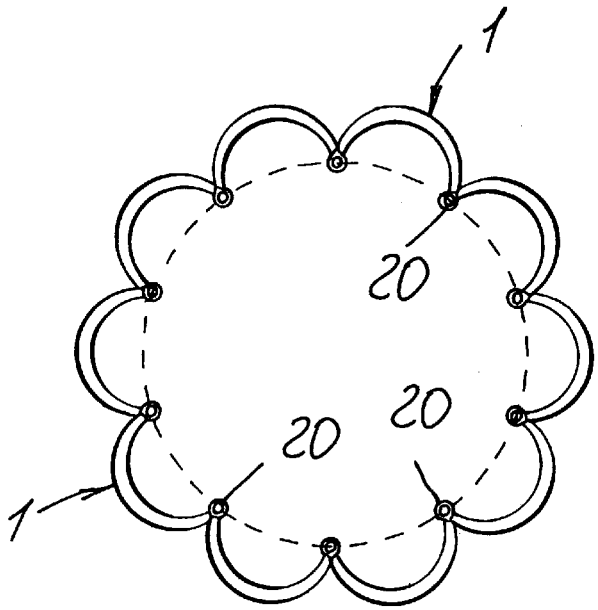

Actually, FIG. 5 illustrates the case in which n=3 and in which the forces are applied to the hinges through pins supported by the two plates (16), like those shown in FIG. 6.

The top plate would be reversed and, in the case being considered, it would be rotated clockwise through 60 degrees, so as to cause the longer pin (17) of a plate to align with the shorter pin of the other plate, as well as the two medium size pins.

Thus, it will be possible to properly assemble the S-shape elements which, because of their thickness will lie on different planes.

The central pin, which is indicated by the reference letter C, is not connected to any external elements and undergoes a displacement corresponding to one half the displacement observed between the points A and B.

In this connection it should be pointed out that, compared with the above mentioned patent application, while the displacements are doubled, the top plan size of the anti-seismic device will remain the same.

As stated, the height size is not a critical parameter.

This embodiment of the dissipating device is very simple construction-wise, of very reduced size and more-over it can be easily constructed.

However, if vertical loads must be simultaneously transmitted, i.e. if a seismic insulator type of device must be constructed, the device will have the same drawbacks as the preceding device.

On the other hand, it is possible to overcome this drawback by adopting the so-called "annular" solution.

Figure 1:
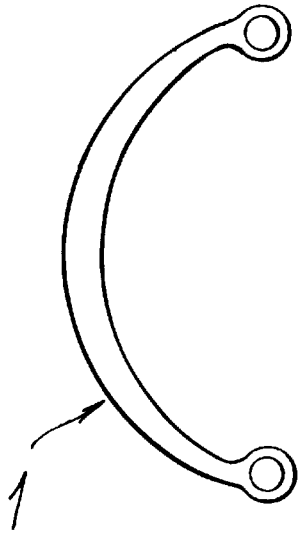
FIG. 1 is a top plan view of an energy dissipating element according to the prior art.

For constructing an annular embodiment of the dissipating device, the dissipating elements (4) shown in FIG. 1 must be used.

These dissipating elements (4) will be arranged with an even number (n=4, 6, 8, etc. . . . ), according to FIGS. 7 to 10.

In actual practice, in the case of comparatively large displacements, the number of crescent moon elements to be used for constructing a device will be double, triple, and so on, with respect to that shown in the above mentioned figures, since it will be necessary to use several arrangements in a superimposed relationship.

Figure 12:
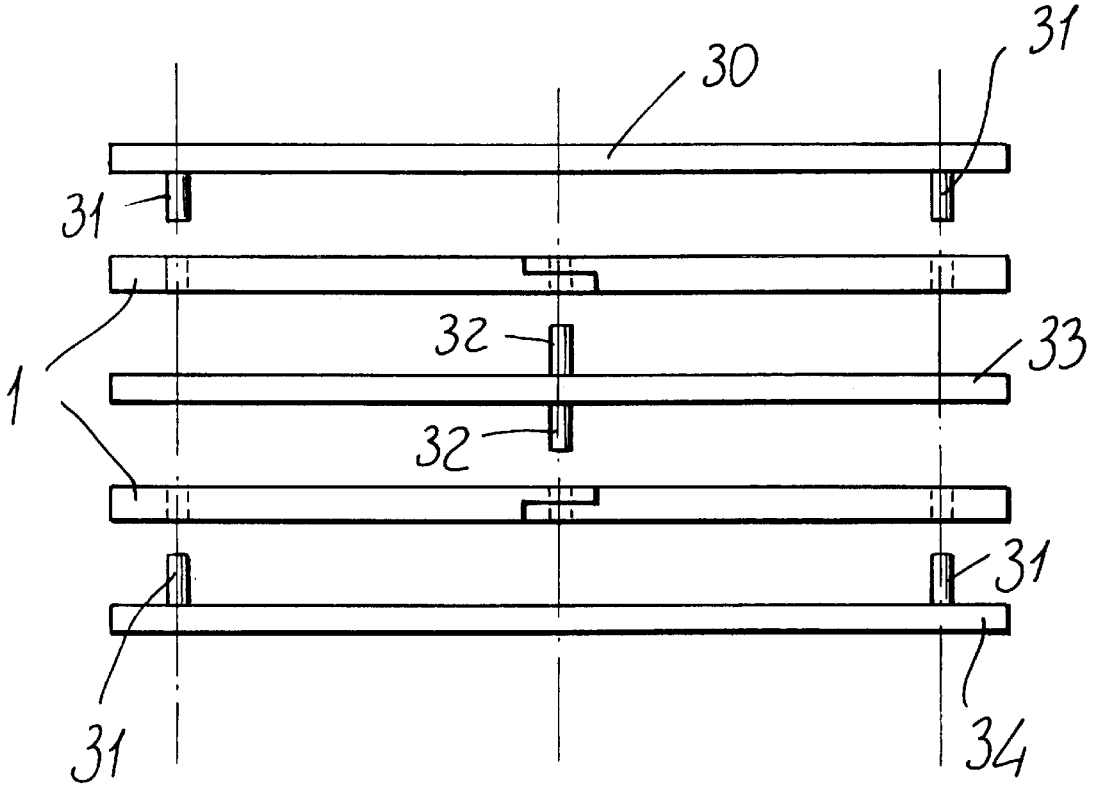
FIG. 12 is an elevational view illustrating two superimposed devices with the configuration of FIG. 7.

By way of an illustrative and not limitative example FIG. 12 shows an exploded view of a very simple case of two superimposed patterns, having the configuration herein shown.

Figure 11:
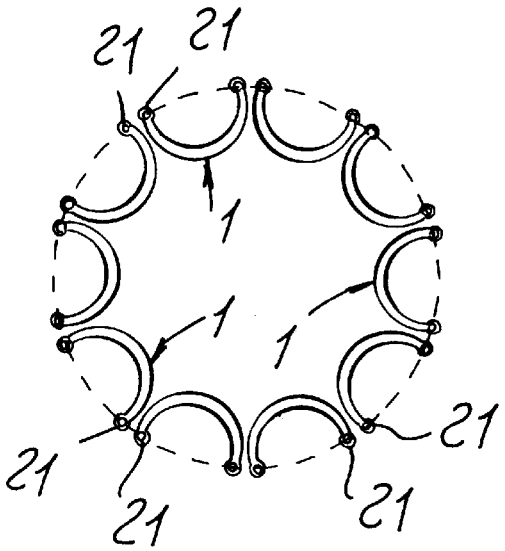
FIG. 11 illustrates a different arrangement of the device of this invention.

FIG. 11 illustrates a case in which the adjoining dissipating elements (1) are connected by discrete pins (21) instead of a single or same pin (20).

Such an arrangement will overcome the drawback of suitably contouring the end portions of the dissipating elements in order to prevent the overlaying arrangement from excessively increasing the height of the assembly.

It should be further pointed out that in each type of arrangement, the overall reaction will be obtained by a vectorial sum of the reactions of the single dissipating elements.

By the same type of dissipating element it will be accordingly possible to obtain by several different arrangements, different stiffness of the elastic and post-elastic branches of the characteristic curve of the overall device.

This latter device, in this illustrative but not limitative embodiment, will comprise a top plate (30), including two pins (31), diametrically arranged, engaging into the holes (B) (FIG. 7) of the dissipating elements while the holes (A) will be engaged by pins (32) encased in congruency plate (33).

The bottom portion of the device is symmetrically repeated and comprises the dissipating elements (2) and bottom plate (34).

The congruency or fitting plate (33) will provide the same function of the pin (C) as that of the radial embodiment.

This plate, similar to the pin, is not directly connected to external elements and will undergo a displacement corresponding to one half of the overall displacement.

Figure 13:
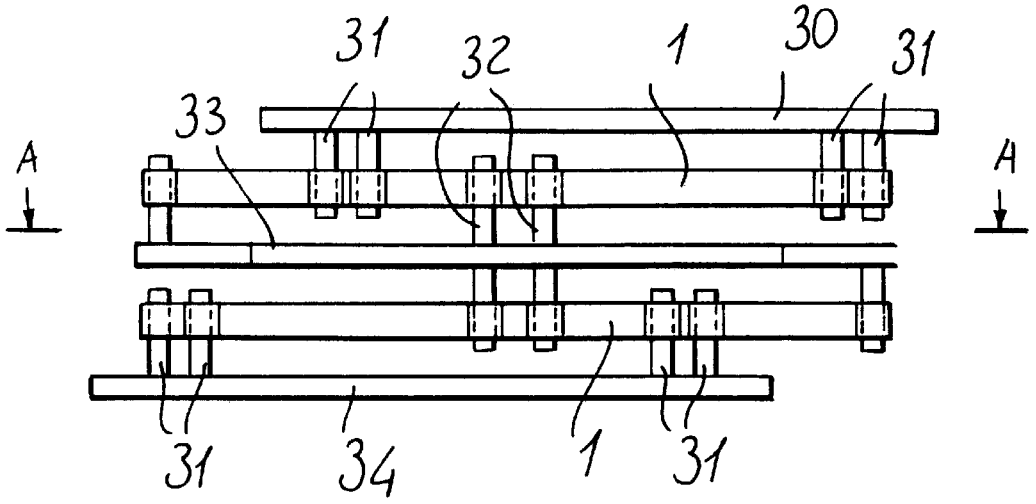
FIG. 13 illustrates the overall displacement of the device shown in FIG. 12.

In this connection it should be apparent that the overall displacement will correspond to the sum of the displacements which can be obtained by any single arrangements, as clearly shown in FIG. 13.

Figure 14:
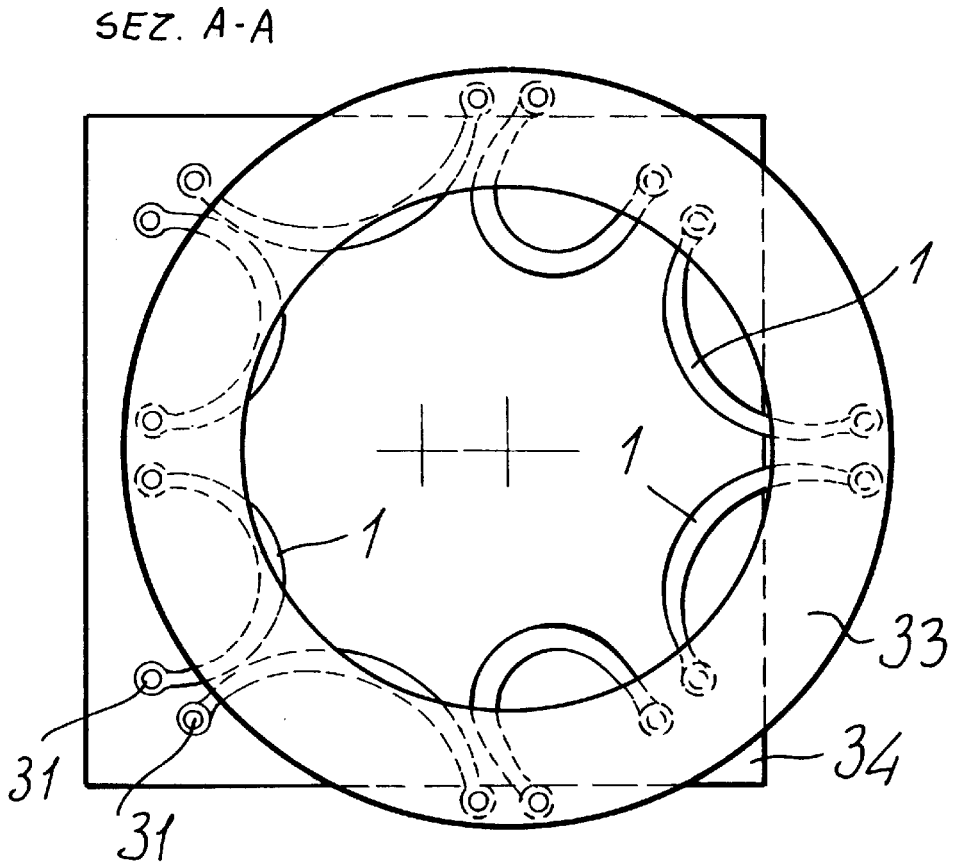
FIG. 14 illustrates a cross-sectional view, substantially taken according to the arrows A/A of FIG. 13.

FIG. 14 illustrates a deformed condition of an arrangement including eight dissipating elements.

With the other geometric characteristics of the dissipating elements being the same, the reaction of the device can be changed by suitably modifying the thickness of said dissipating elements.

It is also possible to change the geometric characteristics, and in particular the thickness exclusively of some elements of the arrangement, thereby providing a different reaction in the different directions.

As clearly shown in FIG. 14, the fitting plate (33) can be designed as a circular crown and in the free central space so provided; it will be possible to insert an element suitable for transmitting vertical loads.

Actually, a main object of the present invention has been that of providing a load dissipating and limiting device also operating as a bearing apparatus, i.e. as previously stated, as an "insulator".

Figure 15:
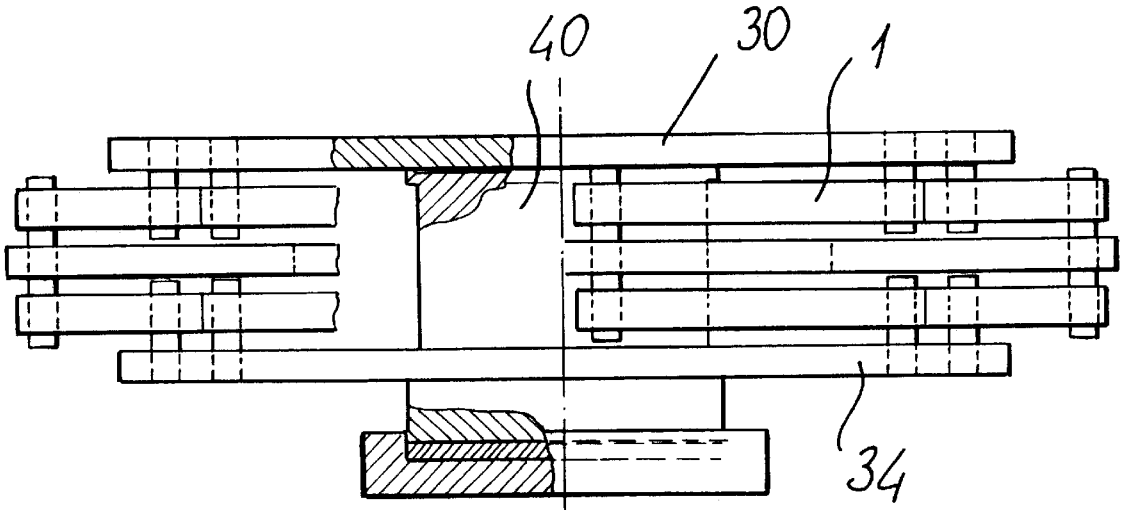
FIG. 15 illustrates an embodiment of the device comprising an insert between the top plate and bottom plate.

With reference to FIG. 15, in the central portion of the apparatus it will be possible to place insert (4) which couples the top plate (30) to the bottom plate (34) to which the insert is fixed.

The insert on the top face thereof will support a sliding block made of PTFE which, in turn, will slide on a polished stainless steel sheet, connected to the top plate.

Thus, mutual displacements between the two facing components will be afforded.

In this connection, it should be pointed out that the insert can be rigid with the top plate and slide on the lower plate.

Under the bottom plate is arranged a conventional bearing apparatus allowing rotation movements to be easily performed.

In the not limitative example shown in FIG. 15, this bearing apparatus is of a vat type, but it can be constituted by any other suitable type of apparatus.

Figure 16:
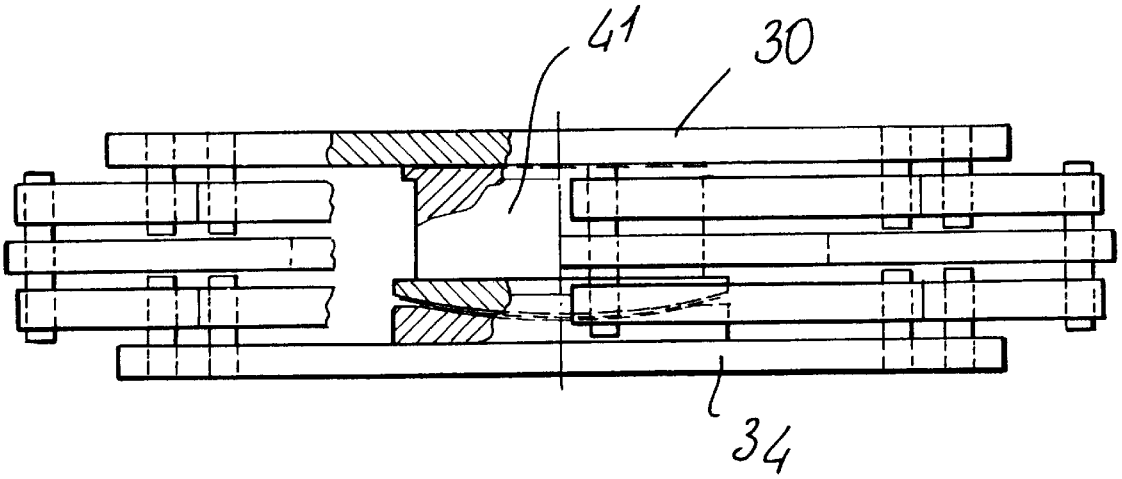
FIG. 16 illustrates an embodiment with a reduced height.

If the height is a critical factor, the bearing apparatus can be introduced inside the two plates, so as to fully or partially exploit the height of the insert, indicated at (41), as the illustrative and not limitative example of FIG. 16.

The latter solution can involve a greater radial size.

To the foregoing it should be added that the device of this invention can also comprise other means for affixing it temporarily to service loads, such as keys to be broken at a given load, rigid clamping elements coupling the end portions of all the dissipating elements or a portion thereof, or guides, either with or without breaking keys, or plungers or hydraulic members (shock-transmitters) to absorb slow motions (for example thermally generated motions) without stressing the dissipating elements.

Further additional elements can also comprise spacing elements which, as suitably connected to the congruency plate and provided at the other end thereof with sliding blocks made of suitable materials, will prevent the congruency plate from being tilted under a pair of action/reaction horizontal forces laying on different planes.

The invention as disclosed is susceptible to several variations and modifications all of which will come within the scope of the inventive concept.

Moreover, all of the details can be replaced by other technically equivalent elements.

In practicing the invention, the used materials, as well as the contingent size and shapes, can be any, depending on requirements.

What is claimed is:

1. An antiseismic device having overall plan view dimensions, which comprises at least two curvilinear dissipating and load limiting elements configured on superimposed planes to accommodate horizontal displacements without increasing said overall plan view dimensions.

2. The device according to claim 1 wherein said curvilinear dissipating elements and load limiting elements are "crescent moon" shaped.

3. The device according to claim 1 wherein said dissipating and load limiting elements are designed for bridges, viaducts, off-shore platforms and comprise an elongated S-shaped body having cylindrical or spherical hinge connecting elements at the extremities of said body and a variable cross-section mid-portion capable of undergoing hysteretic deformations.

4. The device according to claim 2 which has overall radial dimensions and is produced by annular arrangement of said "crescent moon" dissipating elements, said device being capable of accommodating displacements twice that of devices of equal overall radial dimensions.

5. The device according to claim 1 which has a top and a bottom plate, and is provided with a bearing positioned inside or outside said top and bottom plate and serves as a seismic insulator.

6. The device according to claim 1 wherein at least some of said dissipating elements have end portions, said device is provided with rigid clamping elements, said clamping elements coupling said end portions of at least some of said dissipating elements.

7. The device according to claim 1 which is provided with guides and restraints whereby said device is temporarily fixed.

8. The device according to claim 1 which is provided with shock absorbers.

9. The device according to claim 4 which comprises assembling and anchoring plates, said plates being provided with connecting elements, said connecting elements having a varying length, for connecting on different planes said dissipating and load limiting elements, whereby said elements are free from obstruction with one another during operation.

10. The device according to claim 9 wherein said connecting elements are pins.

11. The device according to claim 9, which is provided with horizontal restraining devices and said dissipating and limiting elements have high hysteretic capacity.

12. The device according to claim 11 wherein said dissipating and load limiting elements have a different thickness.

* * * * *